US007638935B2

(12) United States Patent
Liu et al.

(10) Patent No.: US 7,638,935 B2
(45) Date of Patent: Dec. 29, 2009

(54) FIELD EMISSION CATHODE AND LIGHT SOURCE APPARATUS USING SAME

(75) Inventors: Peng Liu, Beijing (CN); Yang Wei, Beijing (CN); Lei-Mei Sheng, Beijing (CN); Liang Liu, Beijing (CN); Zhao-Fu Hu, Beijing (CN); Cai-Lin Guo, Beijing (CN); Pi-Jin Chen, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 648 days.

(21) Appl. No.: 11/181,552

(22) Filed: Jul. 14, 2005

(65) Prior Publication Data

US 2006/0250066 A1 Nov. 9, 2006

(30) Foreign Application Priority Data

Jul. 22, 2004 (CN) ..... 2004 1 0554070

(51) Int. Cl.
*H01J 61/02* (2006.01)
*H01J 61/35* (2006.01)
*H01J 1/304* (2006.01)

(52) U.S. Cl. ..... 313/491; 313/581; 313/309; 313/311; 977/939

(58) Field of Classification Search ..... 313/495–497, 313/309–311, 491, 581
See application file for complete search history.

(56) References Cited

U.S. PATENT DOCUMENTS 5,589,731 A 12/1996 Fahlen et al.
5,600,200 A 2/1997 Kumar et al.
5,764,004 A * 6/1998 Rabinowitz ..... 315/169.1
5,789,857 A 8/1998 Yamaura et al.
6,008,575 A 12/1999 Kaftanov et al.
6,031,328 A * 2/2000 Nakamoto ..... 313/495
6,426,590 B1 * 7/2002 Chung et al. ..... 313/496
6,661,445 B2 12/2003 Mashimo et al.
6,873,095 B1 * 3/2005 Kjellman et al. ..... 313/336
2001/0008361 A1 * 7/2001 Ogawa et al. ..... 313/492
2002/0070648 A1 6/2002 Forsberg
2003/0102799 A1 6/2003 Yonezawa et al.

(Continued)

FOREIGN PATENT DOCUMENTS

CN 1054695 A 9/1991

(Continued)

*Primary Examiner*—Mariceli Santiago
(74) *Attorney, Agent, or Firm*—D. Austin Bonderer

(57) ABSTRACT

A light source apparatus (8) includes a rear plate (80), a front plate formed with an anode layer (82), and a cathode (81) interposed therebetween. The cathode includes a plurality of electrically conductive carriers (812) and a plurality of field emitters (816) formed thereon. The field emitters are uniformly distributed on anode-facing surfaces of the conductive carriers. Preferably, the field emitters extend radially outwardly from the corresponding conductive carriers. The conductive carriers are parallel with each other, and are located substantially on a common plane. Each of the conductive carriers can be connected with a pulling device arranged at least one end thereof, and an example of the pulling device is a spring. The conductive carriers may be cylindrical, prism-shaped or polyhedral.

17 Claims, 5 Drawing Sheets

U.S. PATENT DOCUMENTS

| | | | | |
|---|---|---|---|---|
| 2005/0174059 | A1* | 8/2005 | Obratzsov | 313/634 |
| 2006/0022574 | A1* | 2/2006 | Chen et al. | 313/495 |
| 2006/0066214 | A1* | 3/2006 | Chen et al. | 313/495 |
| 2007/0152564 | A1* | 7/2007 | Lin et al. | 313/496 |

FOREIGN PATENT DOCUMENTS

| | | | |
|---|---|---|---|
| CN | 1355548 | A | 6/2002 |
| CN | 1375730 | A | 10/2002 |
| CN | 1474214 | A | 2/2004 |
| CN | 1504803 | A | 6/2004 |
| EP | 0845154 | B1 | 11/1999 |
| JP | S59-154740 | | 9/1984 |
| JP | H03-30252 | | 2/1991 |
| JP | P2000-138035 | A | 5/2000 |
| WO | WO9707531 | A1 | 2/1997 |

* cited by examiner

FIELD EMISSION CATHODE AND LIGHT SOURCE APPARATUS USING SAME

1. FIELD OF THE INVENTION

The present invention relates to a light source apparatus, and more particularly to a field emission cathode for use in a light source apparatus.

2. BACKGROUND

Flat light sources are virtual necessities in many technical fields, especially in the information display field. Typically, a flat light source having a uniform brightness is a vital component in passive displays such as liquid crystal displays. Conventionally, uniform flat lighting is generally obtained by optical manipulation techniques. For example, a backlight module of a typical liquid crystal display employs an optical system including several optical parts including a light guide plate. The optical system transforms a linear light source or a point light source into a flat light source.

Referring to FIG. 7, a conventional backlight module 10 for use in a liquid crystal display includes a light emitting diode (LED) 12, a light guide plate (LGP) 14, and a micro-lens 16 arranged therebetween. Divergent light beams emitted from the LED 12 are collimated into parallel light beams by the micro-lens 16, and the parallel light beams then propagate into the LGP 14. Subsequently, the light beams are uniformly output from a flat emitting surface of the LGP 14.

However, the above-described backlight modules cannot directly provide a planar light source. Intermediate optical manipulation is required, and some loss of light energy is inevitable. Furthermore, the optical parts such as the micro-lens 16 and the LGP 14 must be precisely manufactured and assembled. This increases manufacturing costs.

Field emission devices are based on emission of electrons in a vacuum in order to produce visible light. Electrons are emitted from micron-sized tips in a strong electric field, and the electrons are accelerated and collide with a fluorescent material. The fluorescent material then emits visible light. Field emission devices are thin and light, and provide high brightness. Up to the present time, light sources including field emission cathodes have been devised. One example is the field emission bulb. Nevertheless, there is no known device based on field emission principles which provides a satisfactory planar light source.

SUMMARY

A light source apparatus provided herein generally includes a field emission cathode. The field emission cathode includes a plurality of electrically conductive carriers and a plurality of field emitters formed thereon.

In one exemplary embodiment, the light source apparatus further includes one anode facing toward the field emission cathode. The light source apparatus may further include a grid electrode arranged between the anode and the field emission cathode. In another exemplary embodiment, the light source apparatus includes two anodes facing to the field emission cathode, and the field emission cathode is arranged between the two anodes.

Preferably, the conductive carriers are parallel with each other, and are located substantially on a common plane. The field emitters may extend radially outwardly from the corresponding conductive carriers. Each of the conductive carriers can be connected with a pulling device arranged at least one end thereof, and an example of the pulling device is a spring. The conductive carriers may be cylindrical, prism-shaped or polyhedral.

A material of the field emitters may be selected from metals, non-metals, compositions, and one-dimension nanomaterials.

These and other features, aspects and advantages will become more apparent from the following detailed description and claims, and the accompanying drawings.

DETAILED DESCRIPTION OF THE PREFERRED EMBODIMENTS

Figure 1:
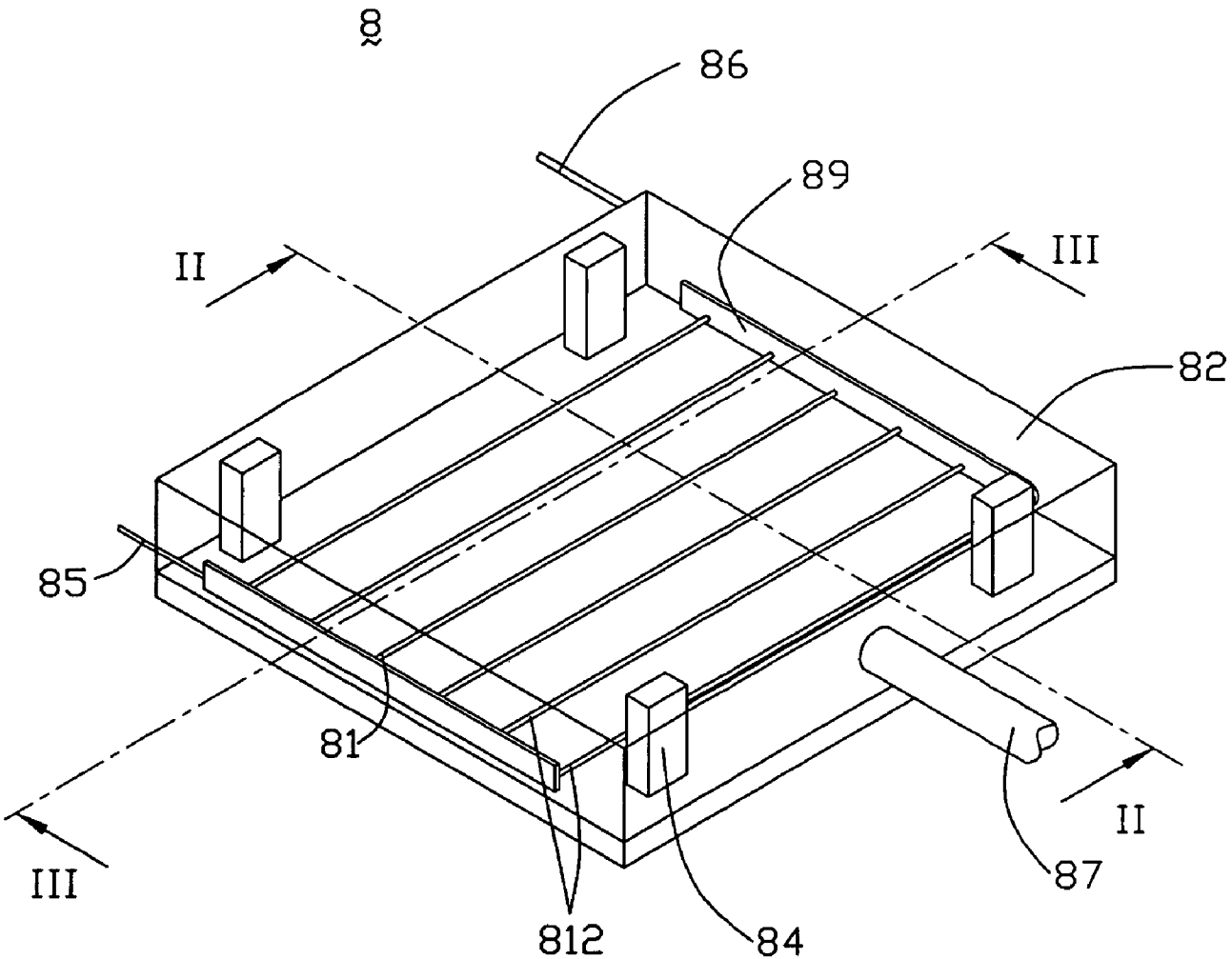
FIG. 1 is a schematic, simplified, isometric view of a light source apparatus in accordance with a first embodiment of the present invention.
Figure 2:
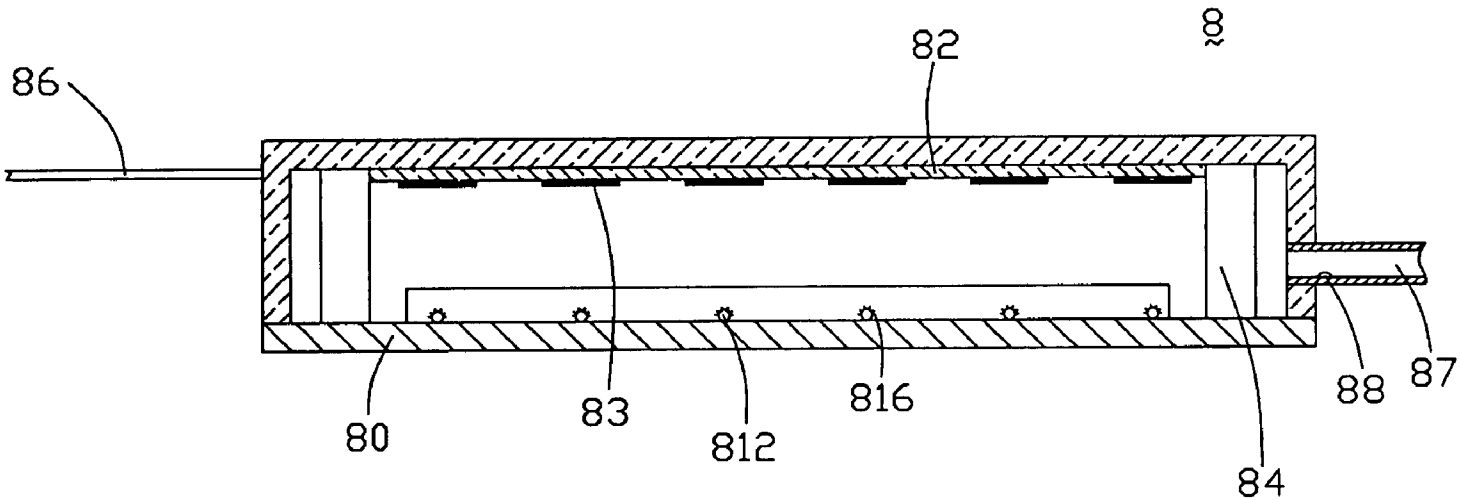
FIG. 2 is a cross-sectional view of the light source apparatus shown in FIG. 1, taken along line II-II thereof.
Figure 3:
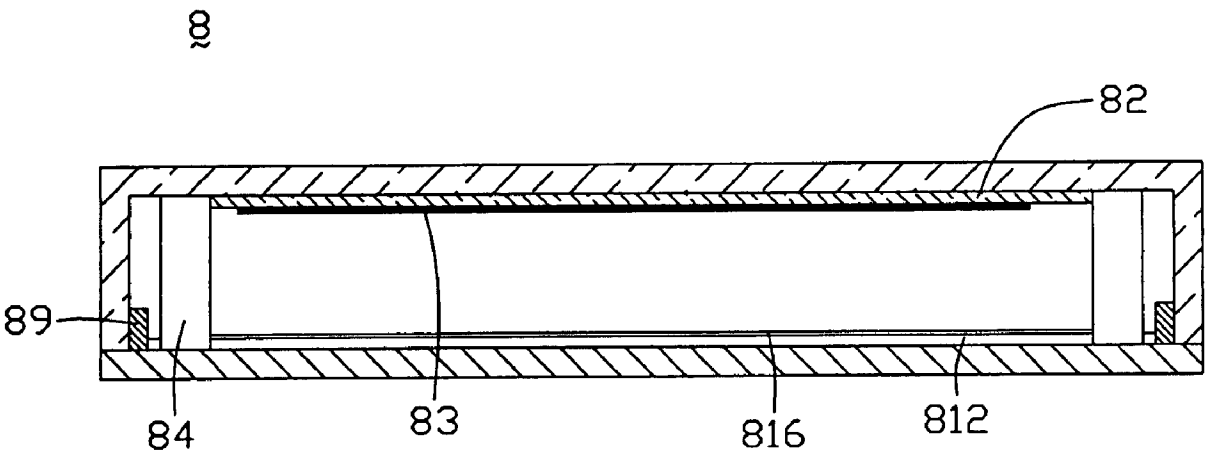
FIG. 3 is a cross-sectional view of the light source apparatus shown in FIG. 1, taken along line III-III thereof.

Referring to FIGS. 1, 2 and 3, a light source apparatus 8 according to a first embodiment of the present invention is shown. The light source apparatus 8 has one lighting surface. As a general overview, the light source apparatus 8 includes a rear plate 80, a front plate (not labeled) formed with an anode layer 82 as the lighting surface, and a cathode 81 interposed therebetween. The front plate and the rear plate 80 are flat and parallel with each other. Four sides of the light source apparatus 8 are sealed by glass plates. A plurality of transparent supporting poles 84 which are made of glass are located between the front plate and the rear plate 80, for strengthening the structure of the light source apparatus 8. An inner space of the light source apparatus 8 is substantially a vacuum.

The cathode 81 includes a plurality of electrically conductive carriers 812 arranged in a predefined common plane, for example parallel to the lighting surface, and a plurality of field emitters 816 formed on the carriers 812. The field emitters 816 are uniformly distributed on anode-facing surfaces of the conductive carriers 812. Preferably, the field emitters 816 extend radially outwardly from the corresponding conductive carriers 812. Consequently, any shielding effect between adjacent field emitters 816 is minimized. Accordingly, an electron-emitting effect of the cathode 81 is increased, and an overall performance of the light source apparatus is improved. In the illustrated embodiment, the carriers 812 are cylindrical, and are parallel with each other. Intervals between two neighboring carriers 812 are uniform. As a result, the field emitters 816 formed on the carriers 812 cooperatively constitute a field emission array. Preferably, the carriers 812 are identical in shape and size, and central axes thereof are arranged substantially in a same common plane. That is, the cathode 81 can provide a flat field emission array. Thereby, a substantially planar light source is achieved, and additional corrective optical components can be omitted.

The cathode 81 is secured by two holding sheets 89, which are located on the rear plate 80 and abut two sides of the light source apparatus 8 respectively. A cathode down-lead 85 is arranged on one side of the cathode 81, for providing electrical connections with each of the carriers 812.

In the illustrated embodiment, the carriers 812 are conductive filaments. The field emitters 816 are formed on the carriers 812 by electrophoresis, chemical vapor deposition (CVD), or another suitable method. The carriers 812 formed with the field emitters 816 are secured on the holding sheets 89, with uniform spaces between the carriers 812. The cathode 81 is thereby formed. Alternatively, the carriers 812 can be secured on the holding sheets 89 before the field emitters 816 are deposited on the carriers 812.

The field emitters 816 have micro-tips, which may for example be tungsten micro-tips, zinc oxide micro-tips, or diamond micro-tips. In general, a material of the field emitters 816 is generally selected from metals, non-metals, compositions, and one-dimensional nanomaterials. The compositions include zinc oxide and other substances known in the art. The one-dimensional nanomaterials may include nanotubes, nanowires, or the like; for example, carbon nanotubes, silicon nanowires, or molybdenum nanowires.

The anode layer 82 is a transparent conductive layer formed like a plate on a cathode-facing surface of the front plate. This can be done by depositing indium-tin oxide on the cathode-facing surface. Fluorescent layers 83 are formed in strips on the anode layer 82, corresponding to each of the carriers 812. The fluorescent layers 83 contain red, green, and yellow fluorescent materials. Alternatively, the fluorescent layers 83 contain white fluorescent materials. Additionally, the anode layer 82 can be formed in parallel strips corresponding to the fluorescent layers 83, or the fluorescent layers 83 can be formed like a plate on the anode layer 82. An anode down-lead 86 is arranged on one side of the anode layer 82, for providing current to the anode layer 82.

It is noted that a particular brightness of the light source apparatus 8 is a function of many factors, such as a voltage and current density of the anode layer 82, and an emitting effect of the fluorescent materials. Such factors can be configured according to need in order to obtain a desired brightness.

One side wall of the light source apparatus 8 defines a vent hole (not labeled), and a vent pipe 87 is engageably received in the vent hole. The vent pipe 87 has a getter 88 on an inner wall thereof, for maintaining a high vacuum of the light source apparatus 8.

Alternatively, if desired, a grid electrode can be arranged between the anode layer 82 and the cathode 81, for extracting electrons from the field emitters 816. For example, the grid electrode can be a metallic net patterned by lithography. Generally, an electron-emitting effect of the field emitters 816 can be increased accordingly.

Figure 4:
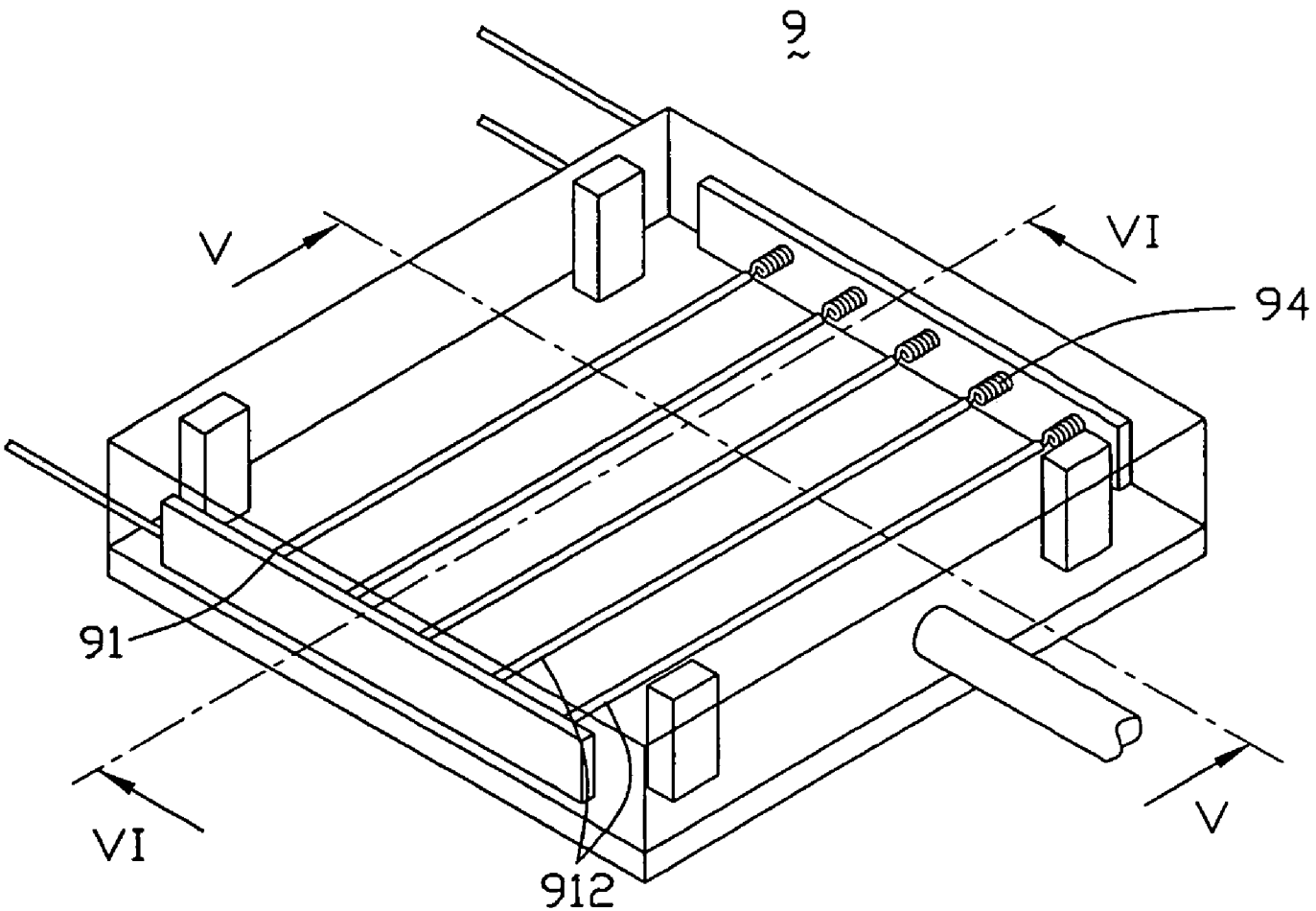
FIG. 4 is a schematic, simplified, isometric view of a light source apparatus in accordance with a second embodiment of the present invention.
Figure 5:
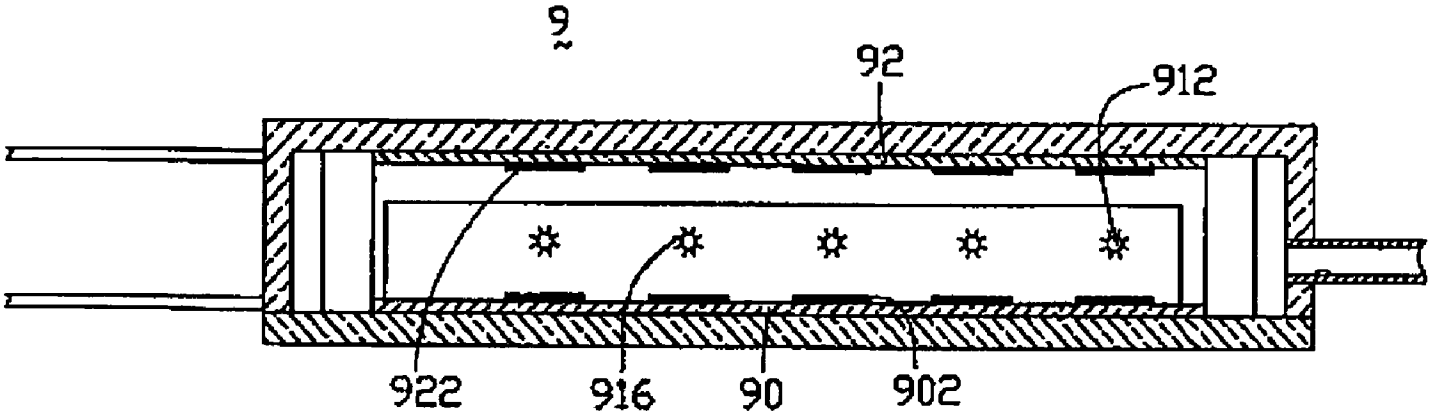
FIG. 5 is a cross-sectional view of the light source apparatus shown in FIG. 4, taken along line V-V thereof.
Figure 6:
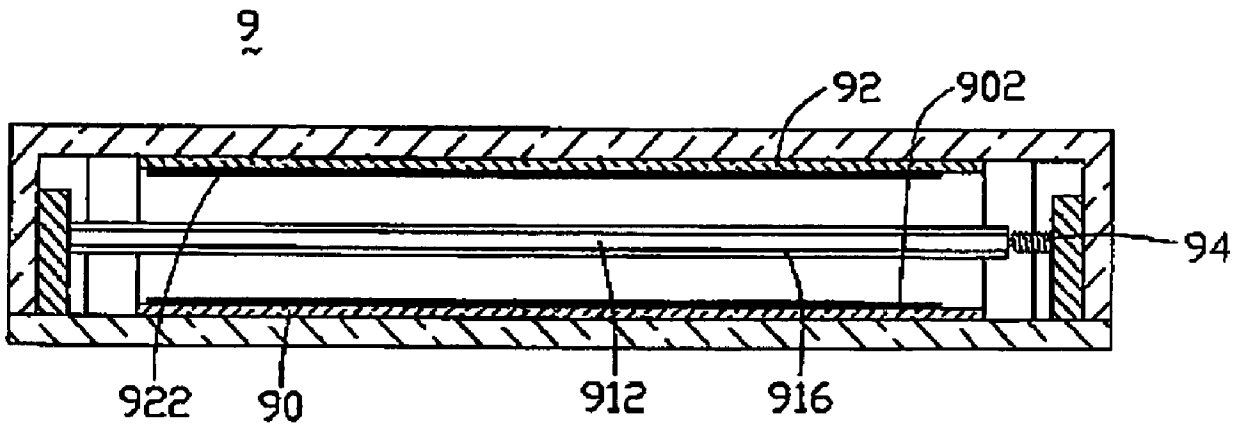
FIG. 6 is a cross-sectional view of the light source apparatus shown in FIG. 4, taken along line VI-VI thereof.
Figure 7:
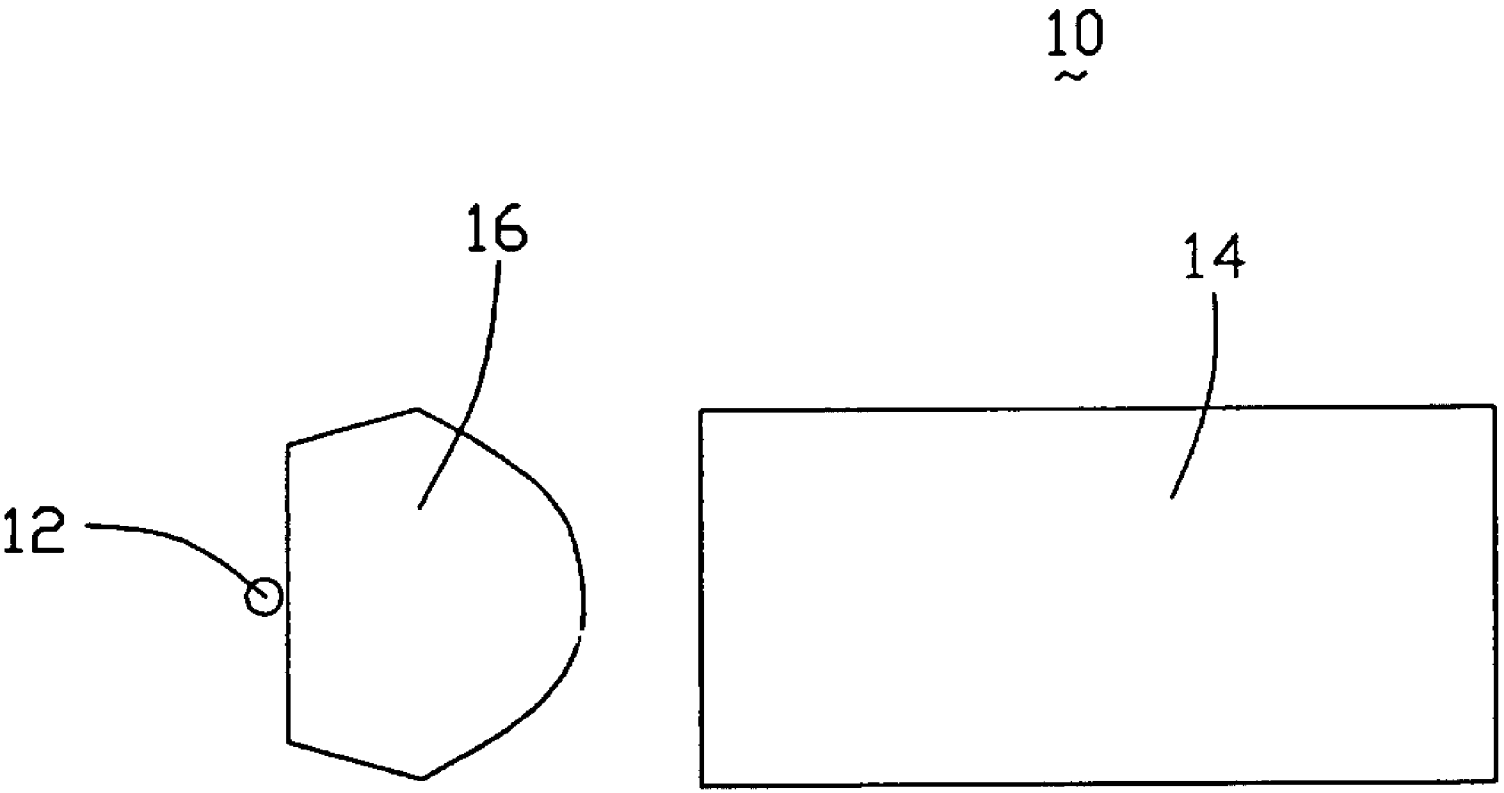
FIG. 7 (RELATED ART)
FIG. 7 is a schematic, side view of a conventional backlight module of a liquid crystal display.

Referring to FIGS. 4, 5 and 6, a light source apparatus 9 according to a second embodiment of the present invention is shown. The light source apparatus 9 has two lighting surfaces. The main difference between the two light source apparatuses 8 and 9 is that in the second embodiment, the light source apparatus 9 includes two anode layers 90, 92, and a cathode 91 located therebetween. Further, the cathode 91 includes a plurality of conductive carriers 912, and a plurality of field emitters 916 formed on both sides of each of the carriers 912 facing toward the two anode layers 90, 92. Further, a plurality of fluorescent layers are formed in strips having a longitudinal axis on the anode layer 90, and a plurality of fluorescent layers are formed in strips having longitudinal axis on the anode layer 92. The longitudinal axis of the plurality of fluorescent layers are parallel with each other and the conductive carriers 912. The plurality of fluorescent layers located on the anode layers 92 face the plurality of fluorescent layers located on the anode layers 90 in a one to one manner. The plurality of conductive carriers 912 are located between the plurality of fluorescent layers located on the anode layers 92 and the plurality of fluorescent layers located on the anode layers 90 in a one to one manner.

Additionally, in the second embodiment, each of the carriers 912 has one end secured on a holding sheet by a spring 94. The spring 94 pulls the carrier 912 and keeps it straight. More particularly, the spring 94 has one flexible end connected with the end of the corresponding carrier 912, and another end fixed on the holding sheet. Accordingly, the carriers 912 are accurately maintained in a common plane. This helps ensure that electron emission is relatively uniform. In addition, the cathode 91 is more stable, and the useful working lifetime of the whole light source apparatus 9 can be increased. Alternatively, each of the carriers 912 can have its both ends connected with springs 94, for providing a better pulling effect.

It should be noted that the carriers may have other shapes suitably adapted for practicing the present invention. For example, the carriers may be prism-shaped or polyhedral. Furthermore, other pulling devices such as filaments can be employed to keep the carriers straight. Moreover, it will be apparent to those skilled in the art that some factors, for example, the number of the carriers, the means for holding the carriers, and the arrangement of down-leads of the electrodes, can be changed according to particular need. In summary, the particular light source apparatuses described above are not critical to practicing the present invention.

It should be further noted that the light source apparatuses 8, 9 can be used in a variety of applications requiring illumination, particularly where a planar light source is required.

Finally, while the present invention has been described with reference to particular embodiments, the description is intended to be illustrative of the invention and is not to be construed as limiting the invention. Therefore, various modifications can be made to the embodiments by those skilled in the art without departing from the true spirit and scope of the invention as defined by the appended claims.

We claim:

1. A light source apparatus comprising:

a field emission cathode including a plurality of conductive carriers, and a plurality of field emitters formed on the conductive carriers;

an upper plate with only one upper anode located thereon;

a lower plate with only one lower anode located thereon; and fluorescent layers formed in strips on each of the upper anode and the lower anode, corresponding to each of the conductive carriers, wherein the field emission cathode is arranged between the upper anode and the lower anode.

2. The light source apparatus according to claim 1, further comprising a grid electrode arranged between the upper anode or the lower anode and the field emission cathode.

3. The light source apparatus according to claim 1, wherein the conductive carriers are parallel with each other, and are located in substantially a common plane.

4. The light source apparatus according to claim 1, wherein the field emitters extend radially outward from the corresponding conductive carriers.

5. The light source apparatus according to claim 1, wherein the field emitters comprises of a material that is selected from the group consisting of metals, non-metals, compositions, and one-dimensional nanomaterials.

6. The light source apparatus according to claim 1, wherein at least one end of each of the conductive carriers is connected with a pulling device.

7. The light source apparatus according to claim 6, wherein the pulling device is a spring.

8. The light source apparatus according to claim 1, wherein the conductive criers are cylindrical, prism-shaped, or polyhedral.

9. The light source apparatus according to claim 1. wherein the conductive carriers are wire shaped.

10. The light source apparatus according to claim 1, wherein length directions of the fluorescent layers are parallel to the conductive carriers.

11. A light source apparatus comprising:

an upper anode;

a plurality of upper fluorescent layers, formed in strips having a longitudinal axis, located on the upper anode;

a lower anode facing the upper anode;

a plurality of lower fluorescent layers, formed in strips having a longitudinal axis, located on the lower anode; and a field emission cathode located between the upper anode and the lower anode, the filed omission cathode comprising a plurality of conductive carriers, and a plurality of field emitters located on the conductive carriers;

wherein the longitudinal axis of the plurality of upper fluorescent layers, the longitudinal axis of the plurality of the lower fluorescent layers, and the plurality of conductive carriers are parallel with each other.

12. The light source apparatus according to claim 11, wherein the field emitters extend radially outward from the corresponding conductive carriers.

13. The light source apparatus according to claim 11, wherein the field emitters comprises of a material that is selected from the group consisting of metals, non-metals, compositions, and one-dimensional nanomaterials.

14. The light source apparatus according to claim 11, wherein at least one end of each of the conductive carriers is connected with a pulling device.

15. The light source apparatus according to claim 14, wherein the pulling device is a spring.

16. The light source apparatus according to claim 11, wherein the conductive carriers are cylindrical, prism-shaped, or polyhedral.

17. A light source apparatus comprising:

an upper anode;

a plurality of upper fluorescent layers, formed in strips having a longitudinal axis, located on the upper anode;

a lower anode facing the upper anode;

a plurality of lower fluorescent layers, formed in strips having a longitudinal axis, located on the lower anode; and a field emission cathode located between the upper anode and the lower anode, the filed emission cathode comprising a plurality of conductive carriers, and a plurality of field emitters located on the conductive carriers;

wherein the longitudinal axis of the plurality of upper fluorescent layers, the longitudinal axis of the plurality of the lower fluorescent layers, and the plurality of conductive carriers are parallel with each other; the plurality of lower fluorescent layers face the plurality of upper fluorescent layers in a one to one manner, and the plurality of conductive carriers are located between the plurality of lower fluorescent layers and the plurality of upper fluorescent layers in a one to one manner.

* * * * *

UNITED STATES PATENT AND TRADEMARK OFFICE

CERTIFICATE OF CORRECTION

PATENT NO. : 7,638,935 B2
APPLICATION NO. : 11/181552
DATED : December 29, 2009
INVENTOR(S) : Liu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1048 days.

Signed and Sealed this

Ninth Day of November, 2010

David J. Kappos

David J. Kappos
*Director of the United States Patent and Trademark Office*